US005573249A

United States Patent [19]

Johnson

[11] Patent Number: 5,573,249

[45] Date of Patent: Nov. 12, 1996

[54] CARD GAME

[76] Inventor: Phillip Johnson, 4222 E. Brown, Lot 16, Mesa, Ariz. 85205

[21] Appl. No.: 296,441

[22] Filed: Aug. 26, 1994

[51] Int. Cl.[6] ..... A63F 1/00

[52] U.S. Cl. ..... 273/292

[58] Field of Search ..... 273/292, 274, 273/309, 85 CP

[56] References Cited

U.S. PATENT DOCUMENTS

| | | | |
|---|---|---|---|
| 5,042,818 | 8/1991 | Weingardt | 273/292 |
| 5,257,810 | 11/1993 | Schorr et al. | 273/292 |
| 5,382,025 | 1/1995 | Sklansky et al. | 273/292 |

OTHER PUBLICATIONS

"Lowball" Hoyle's Modern Encyclopedia Of Card Games, Doubleday & Company, Inc., 1974, pp. 237–238.

*Primary Examiner*—Benjamin H. Layno

*Attorney, Agent, or Firm*—Galgano & Burke

[57] ABSTRACT

Method for playing a card game comprising the steps of providing at least one player with an opportunity to place a wager, displaying a first plurality of playing card indicia to form a plurality of partial card hands, allowing the player to assign the wager to one of the plurality of partial card hands, and subsequently completing the card hands by displaying an additional plurality of card indicia. When the hands have been completed, a winning payout is provided to any and all players who successfully assigned their wagers to the partial card hand which resulted in the complete hand having a particular value, e.g. the highest poker ranking.

8 Claims, 3 Drawing Sheets

CARD GAME

The present invention is directed to a card game and, more particularly, to a card game wherein one or more players are provided with an opportunity to select a card hand from a plurality of partial card hands.

BACKGROUND OF THE INVENTION

Many people get hours of enjoyment from card games. The level of enjoyment for some players is enhanced when the card game is accompanied by wagering.

Poker is a particularly enjoyable game for many players and has many variations. The most common forms of poker are five card and seven variations. In a typical poker hand, players hands are ranked with the following hierarchy, in descending order, Royal Flush, Straight Flush, Four-Of-A-Kind, Full House, Flush, Three-Of-A-Kind, Two Pair, One Pair, and High Card. In "Draw" versions of poker games, players are permitted to discard certain cards and receive new cards in an effort to form better hands.

Those skilled in the gaming industry will appreciate that some players, such as those who frequent casinos and other gaming establishments, often enjoy new games. In order to maximize the profit to a casino, a game should preferably be able to be learned quickly by a casual player and should also be capable of being played in a relatively short amount of time. Since the profit to a gaming establishment is often directly related to the amount wagered, it is in the interest of the gaming establishment to provide games which can be played quickly.

SUMMARY OF THE INVENTION

The various embodiments of the present invention are directed to methods and apparatus for playing card games which comprise the steps of providing at least one player with an opportunity to place a wager, displaying a first plurality of playing card indicia to form a plurality of partial card hands, allowing the player to assign his wager to one of the plurality of partial card hands which that player believes is most likely to result in a complete hand having a particular value relative to the other hands displayed, and subsequently completing the card hands by displaying an additional plurality of card indicia. Once the hands have been completed, a winning payout is provided to any and all players who successfully assigned their wagers to the partial card hand which resulted in the complete hand having a particular value. For example, if the present invention is formed as a variation of the poker game SEVEN CARD STUD and the object is to select the hand having the highest poker ranking, then any and all players who have selected the hand which results in the highest poker ranking will be provided with a winning payout. These and other embodiments are described in detail below with reference to the figures.

DETAIL DESCRIPTION

The various embodiments of the present invention are directed to card games wherein a player attempts to select a winning card hand from a plurality of partially formed card hands. According to the preferred illustrated embodiments of the present invention, players attempt to select the hand having the highest poker ranking in a variation of SEVEN CARD STUD after viewing six partially formed hands having only five cards each. According to these illustrated embodiments of the present invention, a player first selects an amount to wager. The six partial hands are then displayed having five cards each. The player selects which of the partial hands to wager on and assigns the wager to the selected hands. The partial hands are then completed by the display of additional cards. Any player who has selected the winning card hand is then provided with a winning payout while the wagers of other players are collected.

The identification of the winning hand is determined by preselected rules. According to the illustrated embodiments, the winning hand is the hand having the highest poker ranking. It is within the scope of the present invention to utilize other ranking criteria, as well as to change the desired goal. For example, the present invention can be played wherein "winning" hands comprises the lowest poker ranking of the complete hands displayed.

Figure 1:
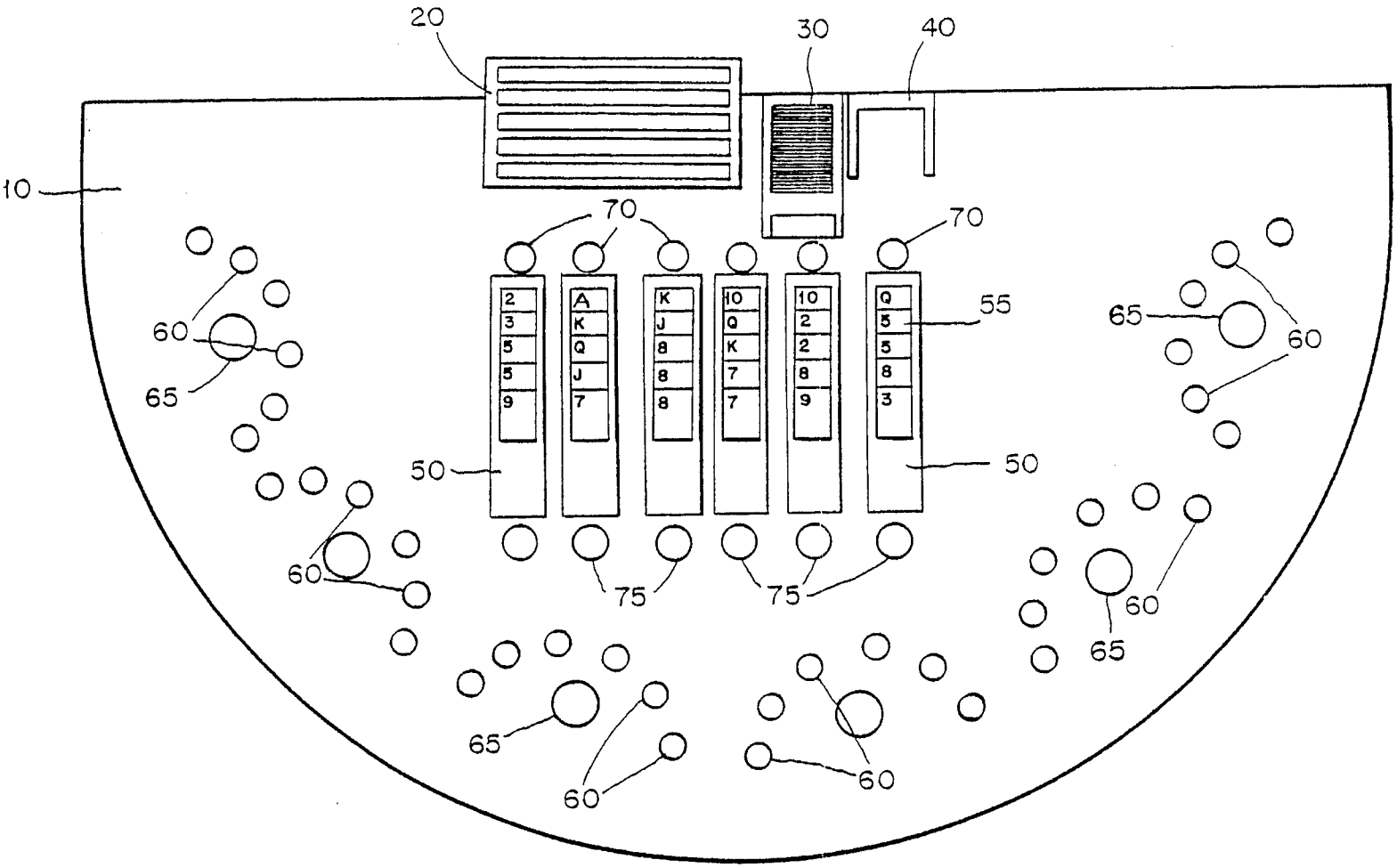
FIG. 1 is a top view of a board game embodiment of the present invention.

FIG. 1 illustrates a game board embodiment of the present invention having a playing surface 10, chip rack 20, card shoe 30 and discard shoe 40. In this illustrated embodiment, six partial card hands each comprising five playing cards 55 are displayed in display areas 50 which are conveniently positioned for viewing by each of the players. A plurality of betting stations are provided with wagering areas 60 on playing surface 10. According to the preferred illustrated embodiment, playing surface 10 is provided with stations for six people, with each station comprising an initial wager area 65 and six wagering areas 60. The number of wagering areas at each betting station advantageously corresponds to the number of card display areas 50. Furthermore, the card display areas 50 are preferably each provided with different colors which advantageously correspond to different colors of each wagering area 60 at a player station. In this manner, when a player makes a selection after viewing the displayed partial card hands, the player's selection can readily be indicated by the dealer moving the player's wager to the wagering area 60 having the same color as the display area 50 corresponding to partial card hand selected by the player. In addition to the use of different colors, the wagering areas 60 and display areas 50 may also comprise other corresponding indicia such as numerals, letters, etc.

In order to provide additional assistance to players as the players select a partial hand on which to wager, a plurality of buttons 70 corresponding to each of the card display areas 50 and in electrical communication with color-coded lights 75 are provided on playing surface 10. In this manner, a dealer can readily indicate which of the partially displayed hands has the highest poker ranking by depressing the button corresponding to the highest partial hand displayed. A visible indication is provided to the players with color-coded lights 75 which correspond to the colors of wagering areas 60 at each player station. In this manner, a player may simply select the hand having the highest poker ranking then displayed.

After a player has selected a partial card hand, the hands are completed by the display of additional cards in each of the display areas 50. If a player has successfully selected the winning hand, which is determined by comparing all of the displayed hands and determining which hand has the highest poker ranking, the player is provided with a winning payout, for example, equal to the amount wagered by that player. It is within the scope of the present invention to provide winning payouts in amounts equal to, less than or greater than the amount wagered to winning players.

Figure 2:
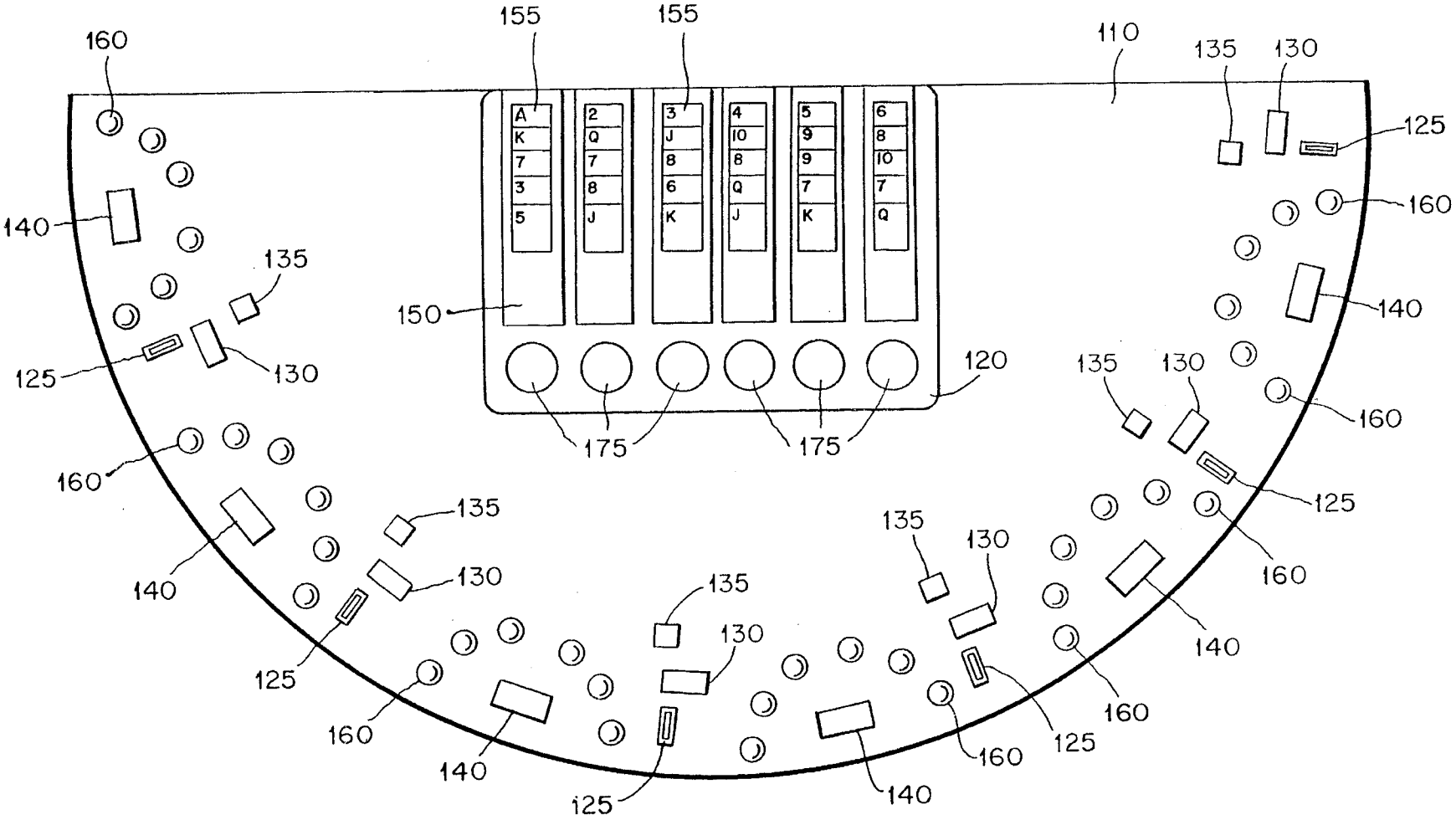
FIG. 2 is a top view of an electronic board game embodiment of the present invention.

FIG. 2 illustrates an alternative embodiment of the present invention wherein the need for a live dealer is eliminated. In other respects, this embodiment of the present invention is played in a manner similar to the embodiment illustrated in FIG. 1. Accordingly to this embodiment, a playing apparatus 110 comprises an electronic screen having a plurality of display areas 150. The card display areas 150 are designed to display a plurality of indicia of playing cards 155. Playing apparatus 110 is provided with six player stations, each of which comprise a coin slot 125, a wager button 130, a display window 140 for showing the amount wagered and any credits that the player has accumulated, and a plurality of HAND SELECTION buttons 160. According to this embodiment of the present invention, a player initiates a game by inserting coins into coin slot 125 or otherwise inputting monetary value, for example through a bill validator (not shown). The amount of currency added by the player will be displayed in window 140 along with the amount of the player's wager for any given hand. The player may also select the amount to be wagered on a given hand by depressing wager selection button 130. For example, if the apparatus 110 is designed to accept quarters and the player wishes to wager $1.00 on a given hand, the player will depress wager button 130 four times. Subsequent wages can then be automatically set at $1.00 per hand by apparatus 110 unless the player again depresses wager button 130. After one or more players have placed wagers, display screen 120 displays a plurality of indicia of playing cards 155 to form a plurality of partial card hands in each of display areas 150. Each player then selects the partial hand upon which the player wishes to wager by depressing button 160 corresponding to the area 150 selected. After each player has made a hand selection, the remaining cards are shown on screen 120 and winning payouts are provided to winning players. The winning amount is shown in display window 140 at the player stations of winning players. When a player desires to stop playing and collect his winnings, the player may simply depress CASH OUT button 135 and is provided with a payout through a coin chute (not shown).

Figure 3:
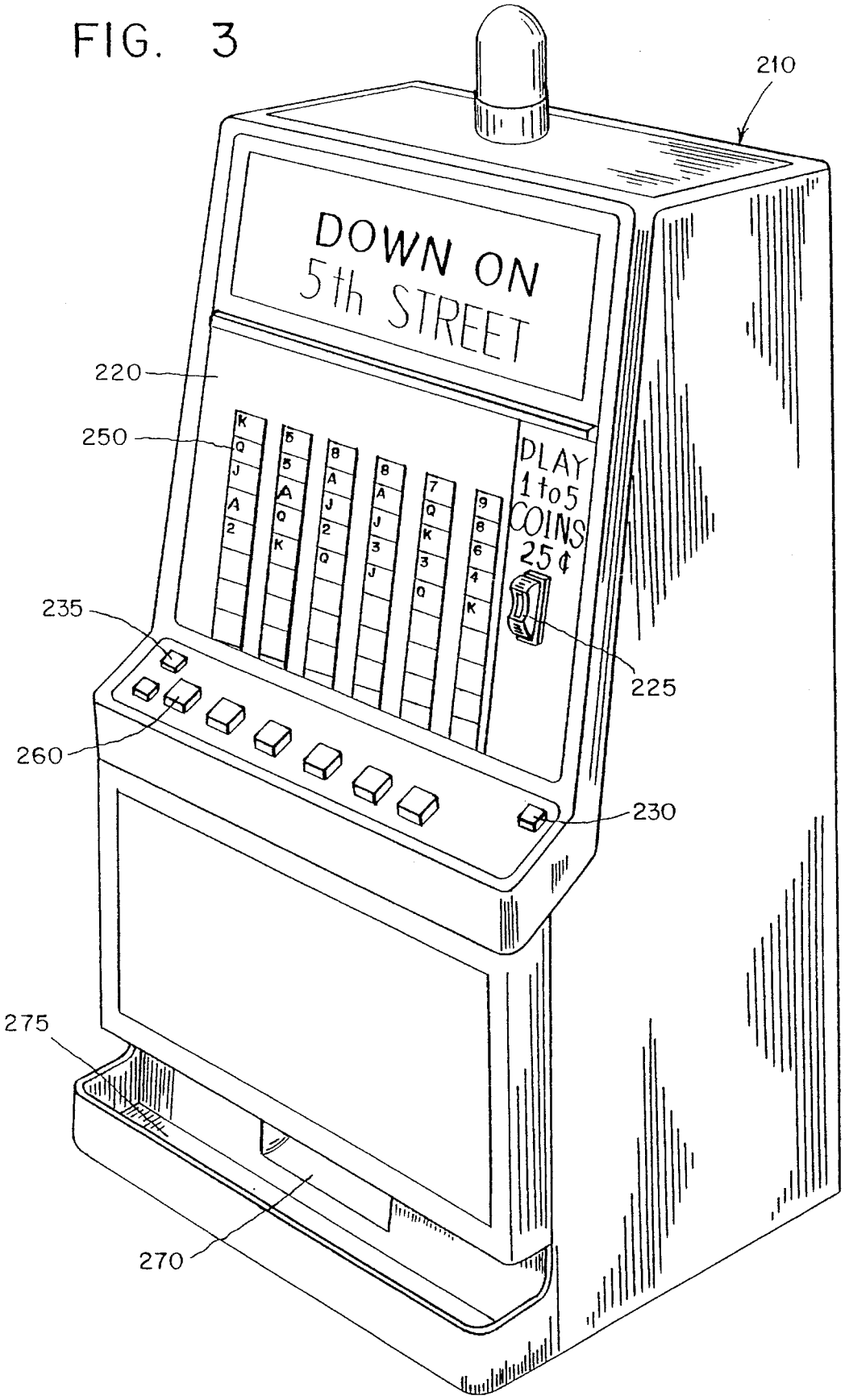
FIG. 3 is a gaming device embodiment of the present invention.

A still further embodiment of the present invention is illustrated in FIG. 3 in the form of a stand alone gaming device having a configuration similar to gaming devices such as video slot machines. According to this embodiment of the present invention, a player plays the same variation of SEVEN CARD STUD described above by inputting currency into coin slot 225 and viewing a plurality of partial card hands on electronic screen 220. SELECT buttons 260 are advantageously aligned with the card display areas 250 in which playing card indicia 255 are displayed to facilitate selection of a partial hand by a player. In a manner which will be readily understood by those skilled in the art, a player can start playing a game on gaming device by depositing coins in coin slot 225. If the player does not choose to wager the entire amount which he deposited in coin chute 225, the player can select the amount to be wagered on a given hand by depressing a wager select button 230. In a manner known in the art, the amount of the player's wager, as well as any credits that the player has accumulated, can be shown on electronic screen 220. After the player has placed a wager, a plurality of partial hands are displayed in display areas 250 on screen 220. The player then indicates which of the displayed partial hands the player selects by depressing one of the CARD SELECT buttons 260. The displayed partial card hands are then completed and, if the player has successfully selected the winning hand, a winning payout is provided. When a player is finished playing this game, the player can depress CASH OUT button 235 in order to receive currency equal to the credits accumulated. Such payouts are dispensed through coin chute 270 into coin trough 275.

According to preferred embodiments of the present invention, after the plurality of partial card hands are displayed, the players are provided with an indication of which of the partial hands has the highest ranking at that time. For example, in the conventional table game version of the present invention, the dealer may announce which of the partial hands has the highest poker ranking. In the electronic versions of the game, lights 175 which are colored to correspond with the colors of buttons 160 may be illuminated or some other discernable indicia such as a visible indication or audible indication may be provided to the players. If the player does not make a selection within a given time period, the selection can be automatically made by the gaming device or dealer which will select the highest ranking partial hand shown.

Furthermore, while the illustrated embodiments have shown the present invention as comprising a plurality of partial card hands comprising five cards, it is also within the scope of the present invention to play the illustrated games with initial partial card hands and complete hands having greater or fewer numbers of cards. It is also possible to play one or more of the illustrated embodiments with a greater or fewer number of partial hands from which the players attempt to select the winning hand.

From the present description, it will be appreciated that the various embodiments of the present invention provide card games which are easy to learn by even a casual card player and which can be played in a relatively short time.

What is claimed is:

1. A method of playing a card game comprising the steps of:

providing a plurality of indicia of conventional playing cards providing at least one player with an opportunity to place a wager;

displaying a first plurality of at least five playing card indicia for each of a plurality of partial card hands, none of said partial card hands sharing playing card indicia;

allowing said at least one player to assign said wager to one of said plurality of partial card hands;

displaying an additional plurality of indicia of playing cards for each hand to complete each display of said partial card hands thereby forming a plurality of complete card hands, and none of said complete hands sharing playing card indicia;

comparing said plurality of complete card hands according to a predetermined hierarchy of winning card hands in order to determine which of said hands has a particular value; and providing a winning payout to a player if said player had assigned a wager to the hand with said particular value.

2. A method of playing a card game according to claim 1 wherein said partial card hands each comprise five cards.

3. A method of playing a card game according to claim 1 wherein said complete card hands each comprise seven cards.

4. A method of playing a card game according to claim 1 wherein said predetermined hierarchy is a poker ranking.

5. A method of playing a card game according to claim 1 wherein said step of displaying a first plurality of playing card indicia comprises displaying playing card images on a screen.

6. A method of playing a card game according to claim 1 wherein said step of displaying a first plurality of playing card indicia comprise displaying playing cards on a playing surface.

7. A method of playing a card game according to claim 1 wherein said particular value is the lowest poker hand of all complete card hands displayed.

8. A method of playing a card game according to claim 1 further comprising the step of providing an indication to each player of the partial card hand having the value closest to said predetermined hierarchy of winning card hands.

* * * * *